US007750572B2

(12) United States Patent
Bariou et al.

(10) Patent No.: US 7,750,572 B2
(45) Date of Patent: Jul. 6, 2010

(54) HIGH-POWER MICROWAVE TUBE WITH BEAM SPREADING IN THE COLLECTOR

(75) Inventors: David Bariou, Palaiseau (FR); Christophe Lievin, Meudon (FR)

(73) Assignee: Thales (FR)

( * ) Notice: Subject to any disclaimer, the term of this patent is extended or adjusted under 35 U.S.C. 154(b) by 86 days.

(21) Appl. No.: 11/718,230

(22) PCT Filed: Oct. 24, 2005

(86) PCT No.: PCT/EP2005/055485

§ 371 (c)(1),
(2), (4) Date: Dec. 17, 2008

(87) PCT Pub. No.: WO2006/045766

PCT Pub. Date: May 4, 2006

(65) Prior Publication Data

US 2009/0102383 A1 Apr. 23, 2009

(30) Foreign Application Priority Data

Oct. 27, 2004 (FR) ..... 04 11449

(51) Int. Cl.
*H01J 23/16* (2006.01)
*H01J 25/10* (2006.01)

(52) U.S. Cl. ..... 315/3; 315/5.43

(58) Field of Classification Search ..... 315/5.35, 315/5.38

See application file for complete search history.

(56) References Cited

U.S. PATENT DOCUMENTS 5,932,971 A * 8/1999 Goebel et al. ..... 315/3.5
6,230,160 B1 5/2001 Chan et al.
6,462,474 B1 * 10/2002 Symons ..... 315/3
6,542,908 B1 4/2003 Ims
6,870,315 B2 * 3/2005 Iguchi et al. ..... 313/582
6,870,318 B2 * 3/2005 Cascone et al. ..... 315/5.35

FOREIGN PATENT DOCUMENTS

| | | |
|---|---|---|
| FR | 1 404 711 | 7/1965 |
| FR | 1 441 197 | 6/1966 |
| FR | 2 568 057 | 1/1986 |
| FR | 2 625 836 | 7/1989 |

(Continued)

OTHER PUBLICATIONS

"Cigee C/C++->CORBA: A generator for CORBA components from legacy C++ code" Online! Apr. 7, 2004 XP002339245.

(Continued)

*Primary Examiner*—Douglas W Owens
*Assistant Examiner*—Minh D A
(74) *Attorney, Agent, or Firm*—Lowe Hauptman Ham & Berner, LLP

(57) ABSTRACT

The invention relates to a microwave power tube consisting of an electron gun comprising a cathode that generates an electron beam in a microwave structure of the tube, and a collector for collecting electrons from the beam. In addition, the tube comprises a magnetic device for spreading the beam in the collector, which generates a periodic amplitude-modulated magnetic spread field Bblm. The invention is suitable for microwave power tubes.

19 Claims, 5 Drawing Sheets

FOREIGN PATENT DOCUMENTS

FR 2 659 792 9/1991

OTHER PUBLICATIONS

Teiniker E et al: "Local components and reuse of legacy code in the CORBA component model" Euromicro Conference 2002. Proceedings, 28$^{TH}$ Sep. 4-6, Piscataway, NJ, USA, IEEE, Sep. 4, 2002, pp. 4-9, XP010612121.

Object Management Group: "CORBA Specification" Common Object Request Broker: Architecture and Specification, Jul. 1995, XP002157374.

* cited by examiner

HIGH-POWER MICROWAVE TUBE WITH BEAM SPREADING IN THE COLLECTOR

CROSS-REFERENCE TO RELATED APPLICATIONS

The present Application is based on International Application No. PCT/EP2005/055563 filed on Oct. 26, 2005, which in turn corresponds to France Application No. 04 11447 filed on Oct. 27, 2004, and priority is hereby claimed under 35 USC §119 based on these applications. Each of these applications are hereby incorporated by reference in their entirety into the present application.

FIELD OF THE INVENTION

The invention relates to high-power microwave tubes and notably the electron collector of the tube.

This invention can be used in klystron-type and gyrotron-type tubes, and traveling wave tubes, etc.

BACKGROUND OF THE INVENTION

High-power microwave tubes provide electromagnetic energy from the kinetic energy of the electrons emitted by a diode (electron gun) of the tube. The electrons from the beam are finally collected at one end of the tube by an electron collector.

FIG. 1 shows the trajectories Tj of the electrons of a beam 2 of electrons in the collector 3 of a klystron. The trajectories Tj of the electrons in the collector of the klystron depend on their energy level. The more energy (or speed) the electron has, the higher is its trajectory in the collector. The slowest electrons have trajectories Tj which are more deflected from the base 4 of the collector and are consequently intercepted lower in the collector. The spreading of the beam on the inside face 5 of the collector therefore depends on the energy spectrum of the electron beam. In the case of a gyrotron, the trajectories of the electrons in the collector are principally connected to the magnetic field lines.

The gyrotron is a microwave generating tube, the structure of which is illustrated in FIG. 2. The gyrotron principally comprises, along a longitudinal axis ZZ' of the tube, an electron gun 12, a magnetic compression section 14, a resonant cavity 16, an injector 18 with a microwave power exit 20 and an electron collector 22.

The electron gun 12 comprises a cathode 26 generating an electron beam 28, along the axis ZZ' of the tube, which has a crown-shaped section. The beam takes the shape of a hollow tube along the axis ZZ'.

A solenoid 30, at the magnetic compression section 14, generates a magnetic field B keeping the electrons emitted by the cathode 12 in the axis ZZ' of the microwave tube.

The electron beam, in yielding part of its kinetic energy in the resonant cavity 16, provides an electromagnetic microwave, channeled by focusing reflectors 34 at the exit of the injector 18, to the power microwave exit 20 of the gyrotron. Approximately 20% to 50% of the kinetic energy of the electrons is converted into electromagnetic energy. On exiting the injector 18, the electrons from the beam will strike the walls of the collector 22, heating it through the conversion of their remaining kinetic energy into heat energy.

In the case of the gyrotron, the electron beam is channeled by the field lines Fi of the magnetic field B generated by the solenoid 30. The trajectories Tj of the electrons are trapped by the magnetic field lines and cannot spread naturally in the collector. The field lines Fi, which are substantially parallel in the compression zone, gradually spread further apart from the axis ZZ' of the tube. The electrons from the beam substantially follow these field lines created by the solenoid 30, and, as a result, the electrons from the beam always impact on a same zone Z1, having a ring shape, on cylindrical inner walls 34 of the collector around the axis ZZ' of the tube.

For an electron beam carrying, for example, a power of 2 MW, the power density dissipated in this ring sector Z1 of the collector is considerable and requires vigorous cooling of the wall. This cooling can be obtained generally by circulation of water using a large and cumbersome cooling installation.

To limit the power density on the collector, magnetic devices are used in the microwave tubes of the prior art to spread the electron impact zone in the collector.

In a first magnetic spreading device of the prior art, the collector of the tube comprises a collector solenoid 40 generating a magnetic field which is weakly divergent in the direction of movement of the electrons. The effect of this diverging magnetic field is to lay down the trajectories of the electrons to make them almost parallel to the walls of the collector. The impact zone is thus considerably lengthened and therefore has its surface increased which reduces the power density on the surface of the collector. The effect of spatial spreading obtained by the magnetic device can be combined with a periodic sweeping effect of the magnetic field in the collector. To this end, the collector solenoid 40 is fed with a periodic signal Ubl of constant amplitude.

FIG. 3 shows a view of the collector 22 of the gyrotron of FIG. 2 of the prior art comprising a magnetic device 39 for spreading the electrons in the collector.

The magnetic spreading device 39 mainly comprises the collector solenoid 40 which is fed with the sinusoidal sweep signal Ubl of constant amplitude at a frequency Fb. The solenoid 40 then produces, in the collector, a sweep field Bbl which can vary in synchronism with the signal Ubl.

The variation of the field Bbl in the collector causes the electron impact zone to move in synchronism with the same signal Ubl, this impact zone moving between a low impact surface Lz with mean position Lp and a high impact surface Hz with mean position Hp. The mean position Mp can be defined, for example, as the position of a circle located at equal distance from the edges of the beam on the impact surface.

FIG. 4 shows the mean position Mp of the impact zone of the electrons on the collector as a function of time t, passing, at the rhythm of the sweep signal Ubl, from the low position Lp to the high position Hp and then in the opposite direction.

The sweep for spreading the beam produced by the signal Ubl reduces the maximum power density on the inner of the collector as a result of the variation of the position of the beam over time. This type of sweep nevertheless has disadvantages. Indeed, the temperature of the collector surface against which the electrons impact is far from being uniform. FIG. 5 shows the variation in the temperature T of the collector as a function of the mean position Mp of impact of the beam.

This figure shows a large variation in the temperature of the collector depending on the mean position Mp of the beam. The temperature is much higher for the low and high positions Lp and Hp of the electron beam corresponding substantially to the cusp points of the variation of the sweep field, i.e. substantially for the maximum and minimum of the sweep spread signal Ubl.

For example, the temperature of the collector (see FIG. 5) for a power gyrotron can vary between a minimum temperature $T_{min}$ of 140° C. between the two cusp points and maximum temperatures $T_{max}$ of around 300° C. at the cusp points.

SUMMARY OF THE INVENTION

In order to overcome the disadvantages of the tubes of the prior art, the invention proposes a microwave power tube consisting of an electron gun comprising a cathode that generates an electron beam in a microwave structure of the tube, a collector for collecting electrons from the beam, and a magnetic device for spreading the beam, which generates a magnetic spread field in the collector, characterized in that the magnetic spread field is periodic and amplitude-modulated.

A principal object of the invention is to even out the variation in temperature on the collector of microwave power tubes. To this end, the amplitude modulation of the signal ensures a variation in time of the cusp position of the beam in the collector.

Another object of this invention is the possibility of simplifying the device for cooling power tubes and therefore reducing the cost.

In one embodiment of the microwave tube according to the invention, the magnetic device for spreading the beam comprises a solenoid fed with a beam-spreading electric signal Ublm, of angular frequency $\omega_1$, which is amplitude-modulated by two other modulating signals, of angular frequencies $\omega_2$ and $\omega_3$ respectively, the spread signal Ublm being normalized at a unitary amplitude S given by the equation:

$$S = \frac{(1 + m \cdot \sin\omega_3 t \cdot \sin\omega_2 t)}{1 + m} \cdot \sin\omega_1 t$$

m being the modulation parameter, with the value of m being between 0 and 1.

In another simplified embodiment, the spread signal of angular frequency $\omega_1$ can be modulated by a single signal of angular frequency $\omega_2$.

BRIEF DESCRIPTION OF THE DRAWING

The invention will be better understood from the descriptions of embodiments of the spreading device of the tube according to the invention with reference to the figures in which.

DETAILED DESCRIPTION OF THE EMBODIMENTS

Figure 6A:
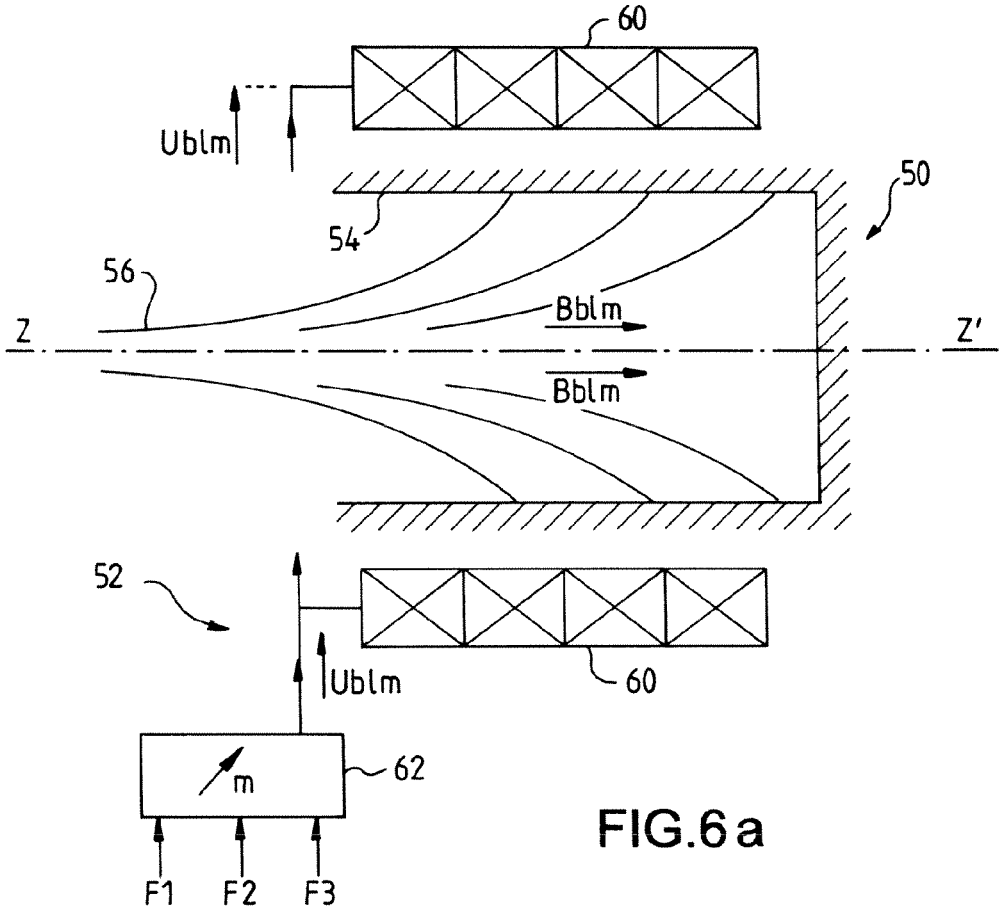
FIG. 6*a* gives a view of a collector of an embodiment of a gyrotron according to the invention.

FIG. 6*a* gives a view of a collector 50 of an embodiment of a gyrotron according to the invention comprising a device 52 for spreading the beam.

The collector 50 comprises a conductive wall 54, which is cylindrical along the axis ZZ' of the tube, for receiving the electrons. A beam 56 of electrons exiting the microwave structure of the tube in particular strikes the conductive inner wall 54 of the collector.

The spreading device comprises a coil 60, with revolution axis ZZ', surrounding the conductive wall 54 of the collector. The coil 60, which is fed with a spread signal Ublm, generates a magnetic spread field Bblm, which is periodic and amplitude-modulated, along the axis ZZ' of the collector 50.

The spread signal Ublm will be given by the signal S which is normalized at an amplitude equal to 1, where Ublm=k.S, k being an amplification factor required to drive the coil 60.

$$S = \frac{(1 + m \cdot \sin\omega_3 t \cdot \sin\omega_2 t)}{1 + m} \cdot \sin\omega_1 t$$

m being the modulation parameter, with its value being between 0 and 1.

The circuit 62, of known type, provides the signal Ublm of angular frequency $\omega_1$ which is amplitude-modulated according to the chosen level of modulation m.

There are circuits of known type in the market of electronic components which provide this type of signal S (or Bblm). For example, such an amplitude-modulated signal S can be obtained from a signal of angular frequency $\omega_1$ with a constant amplitude that is amplified by an amplifier, the gain of which varies according to a first modulation sine wave of angular frequency $\omega_2$, where the resulting signal can be modulated in turn by a second amplifier, the gain of which varies according to a second modulation sine wave of angular frequency $\omega_3$.

The level of modulation m and the angular frequencies $\omega_1$, $\omega_2$ and $\omega_3$ are chosen such as to make the temperature of the wall of the collector as uniform as possible.

In this first embodiment of the beam-spreading device, the modulation frequencies of the signal for driving the coil 60 are:

F1=1/$\omega_1$=50 Hz,

F2=1/$\omega_2$=5 Hz,

F3=1/$\omega_3$=0.5 Hz.

As has already been pointed out, the level of modulation m is chosen so that the corresponding sweep spreading of the beam leads to a temperature on the conductive wall of the collector which is as uniform as possible. Temperature uniformity is, for example, linked to a power density that is substantially constant over the same period of time.

Figure 6B:
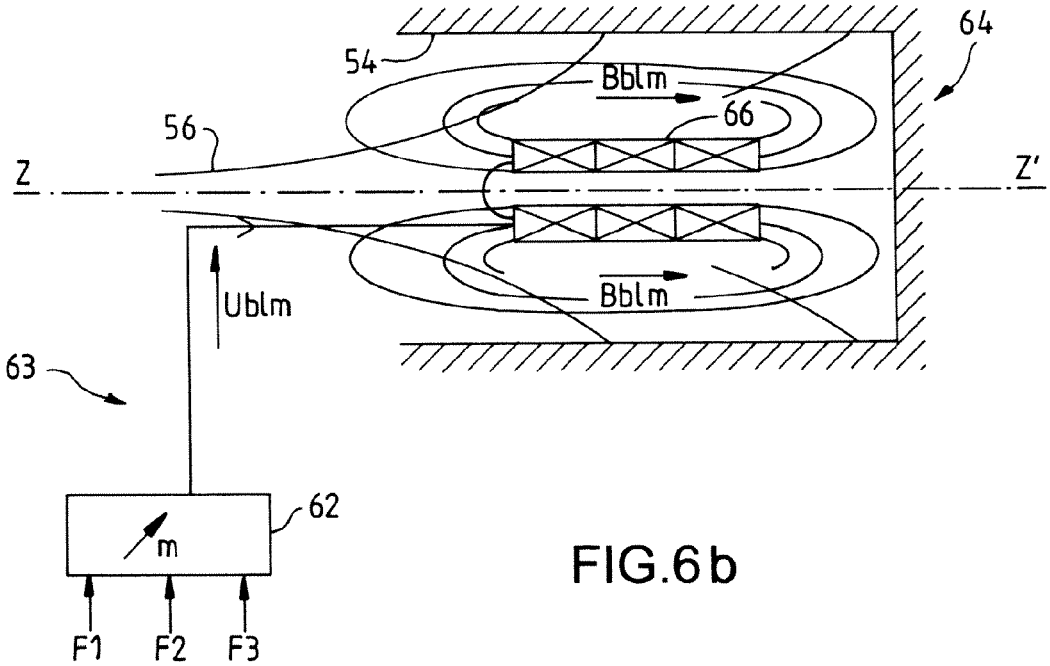
FIG. 6*b* gives a view of the collector of another embodiment of the gyrotron according to the invention.

FIG. 6*b* shows a view of a collector 64 of another embodiment of the gyrotron according to the invention comprising a device 63 for spreading the beam.

In this other embodiment, the collector comprises, inside the collector, a coil 66 for spreading the beam, with an axis that is collinear to the axis ZZ' of the collector, which is fed with the modulation signal Ublm creating the magnetic field for spreading the beam, along the axis ZZ', in the collector 64.

As with the embodiment of FIG. 6*a*, the electronic circuit 62 provides the periodic signal Ublm which is amplitude-modulated to feed the coil 66 creating the magnetic field Bblm for spreading the beam in the collector of the tube according to the invention.

Figure 7A:
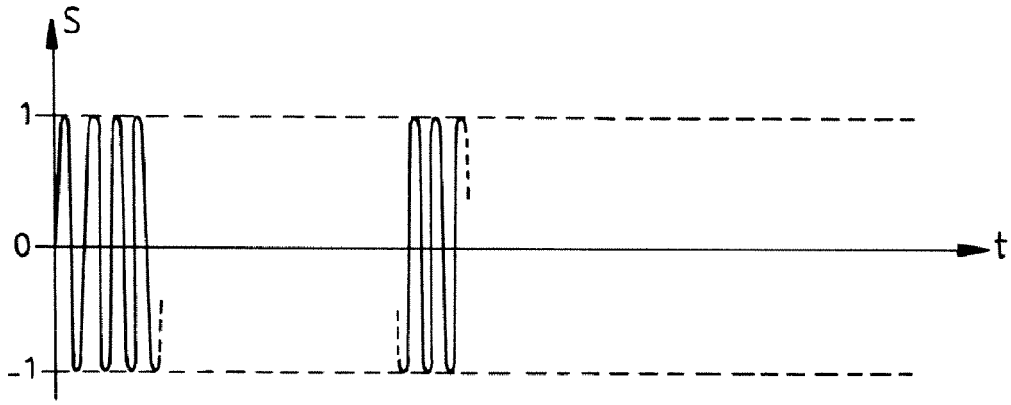
FIGS. 7*a*, 7*b* and 7*c* show the sweep signal for three different modulation levels.
Figure 7B:
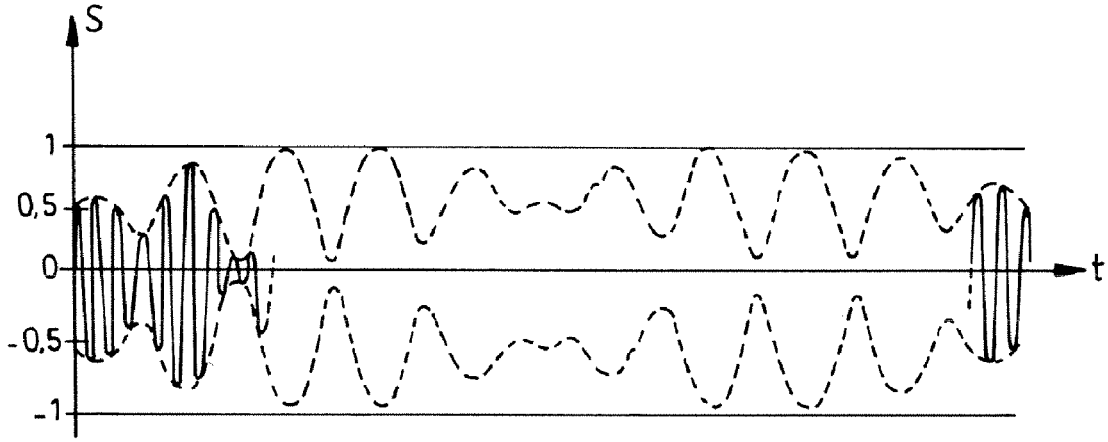
Figure 7C:
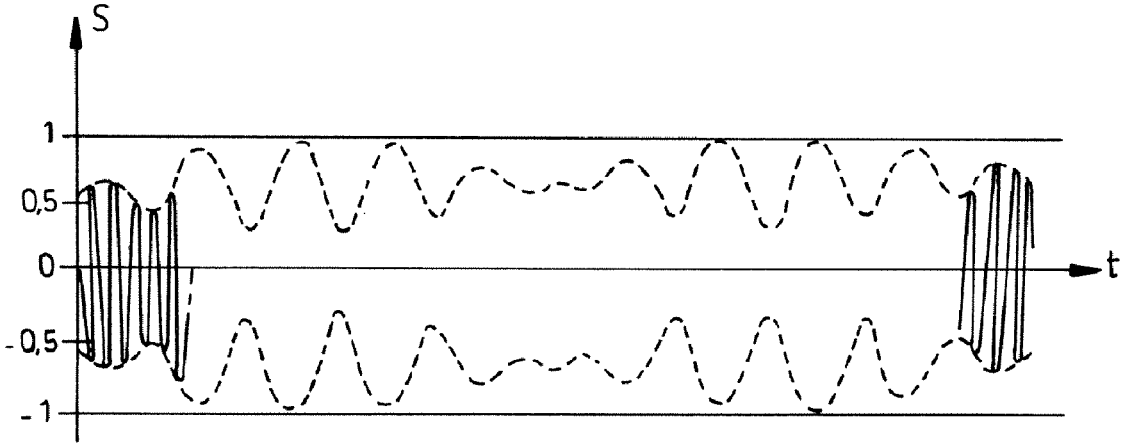
Figure 8:
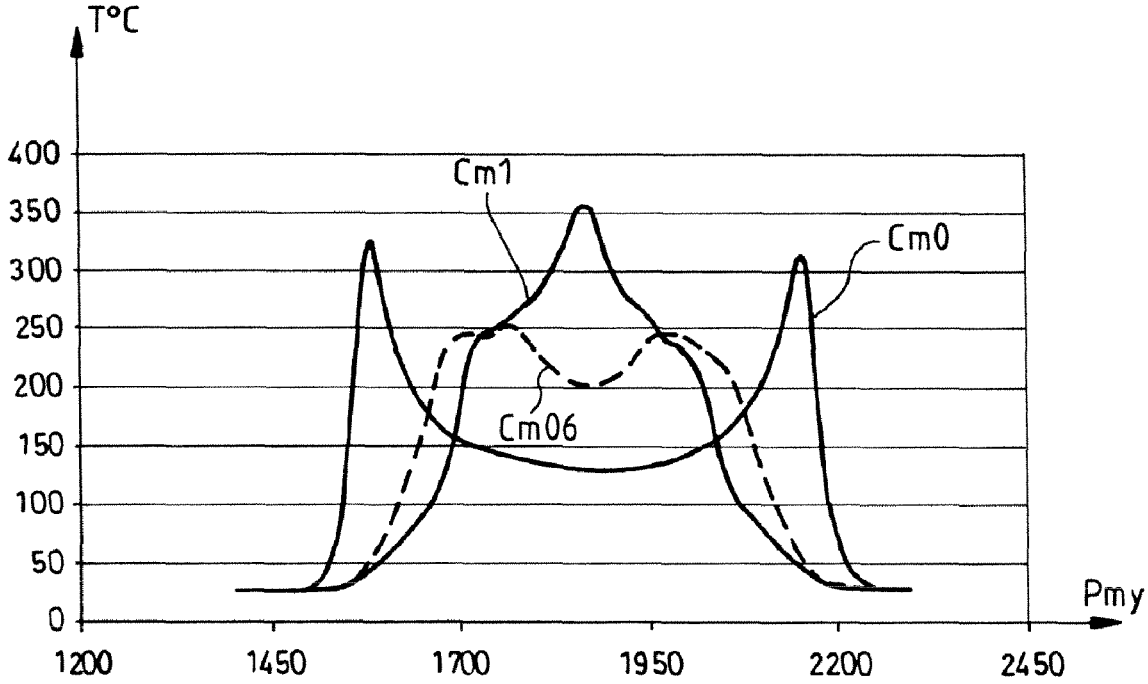
FIG. 8 shows the curves for temperature variation according to the measurement position on the walls of the collector for the three modulation levels of FIGS. 7*a*, 7*b* and 7*c*.

FIGS. 7*a*, 7*b* and 7*c* show the feed signals Ublm for the collector coil for three modulation levels respectively and FIG. 8 shows the temperature curves of the collector, for these three modulation levels, according to the mean position Mp of impact of the beam on the inner surface of the collector.

FIG. 7*a* shows the sweep signal S (Ublm whose amplitude is normalized at 1) without any modulation, m=0. A level of modulation m=0 sees a return to the case of the prior art of the magnetic sweep device fed with a periodic signal having a constant amplitude.

Figure 1:
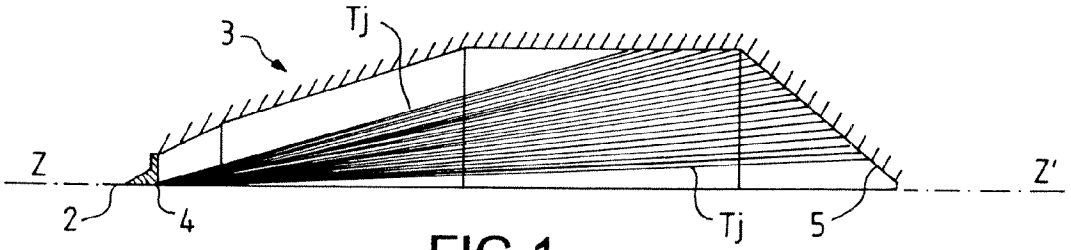
FIG. 1, which has already been described, shows the trajectories Tj of the electrons in the collector of a klystron.
Figure 2:
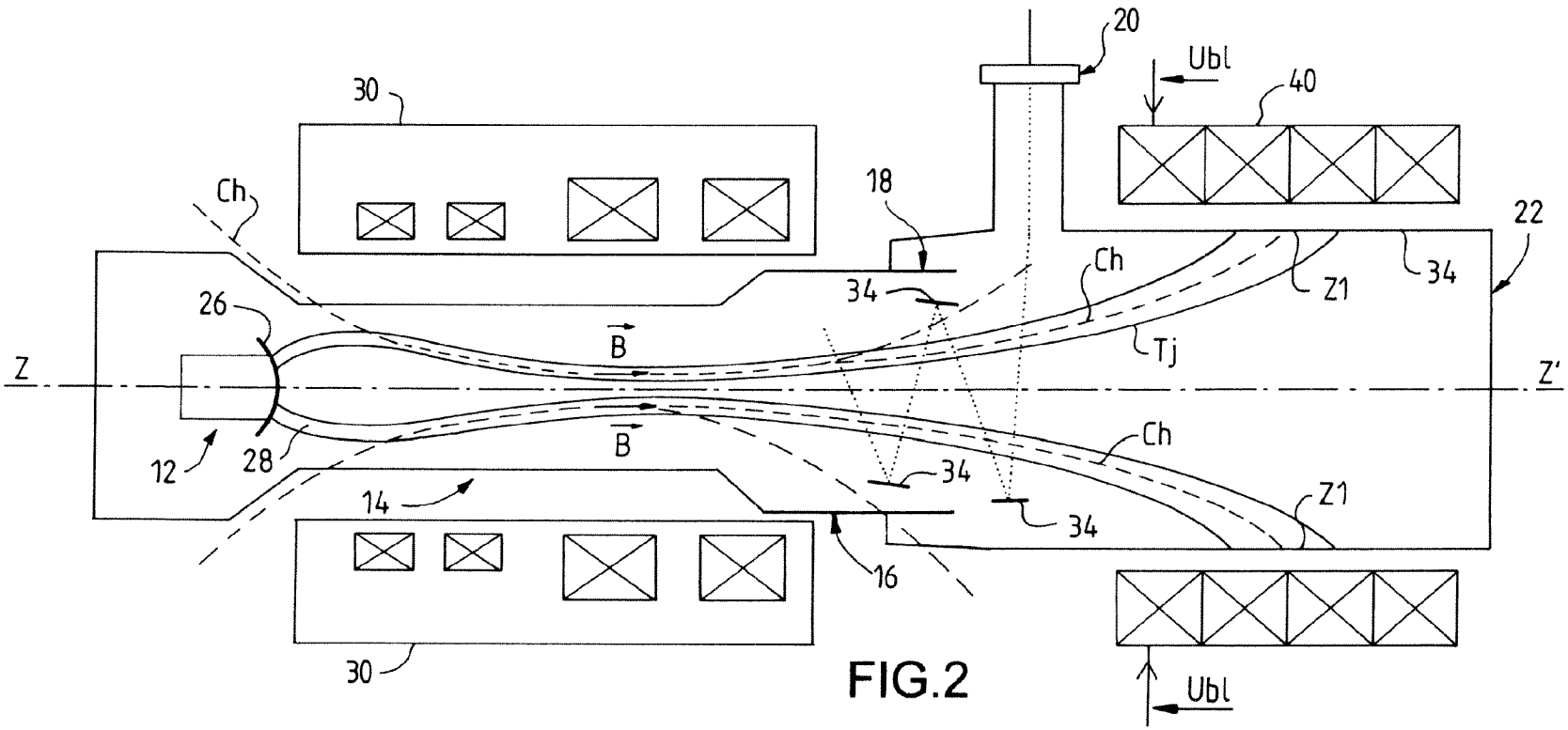
FIG. 2, which has already been described, shows a gyrotron of the prior art.
Figure 3:
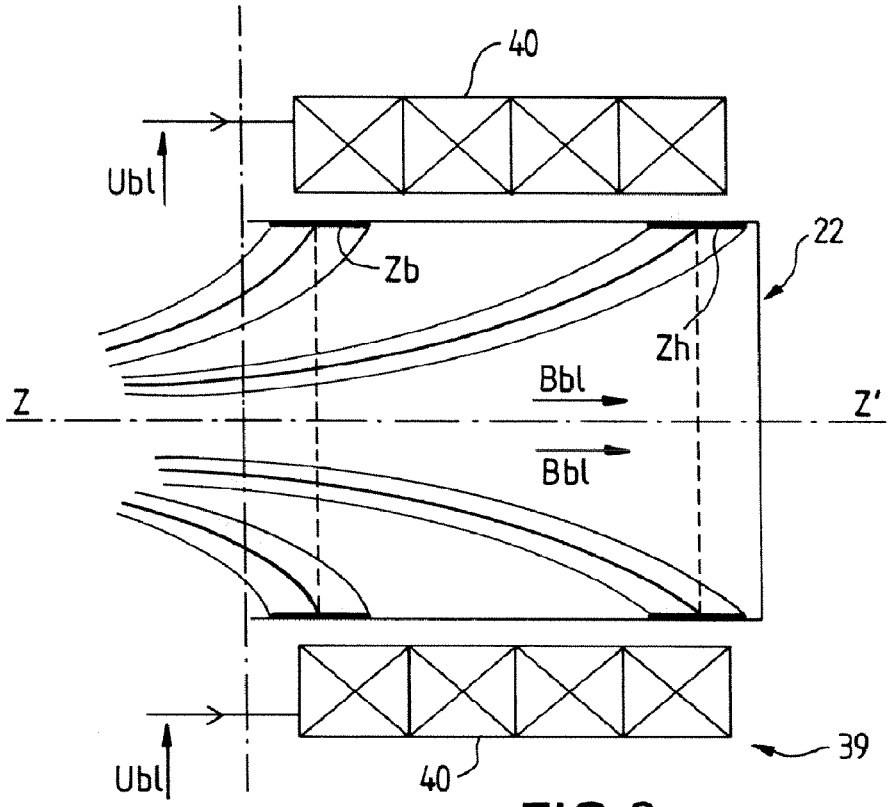
FIG. 3, which has already been described, gives a view of the collector of the gyrotron of FIG. 2.
Figure 4:
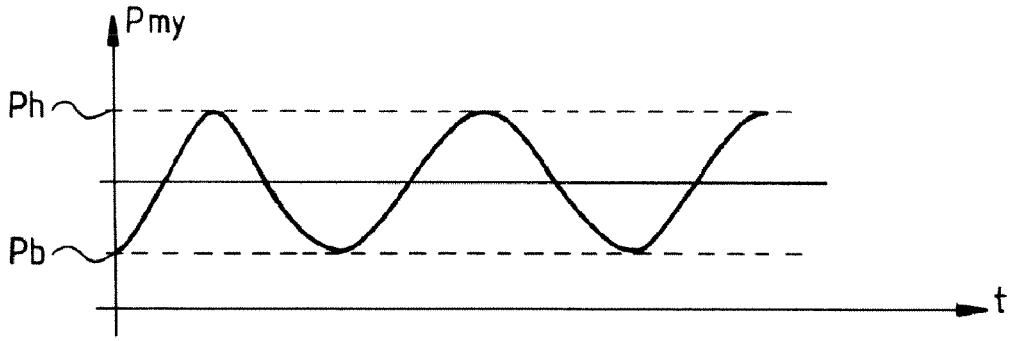
FIG. 4, which has already been described, shows the mean impact position of the electrons on the collector of the gyrotron of FIG. 1.
Figure 5:
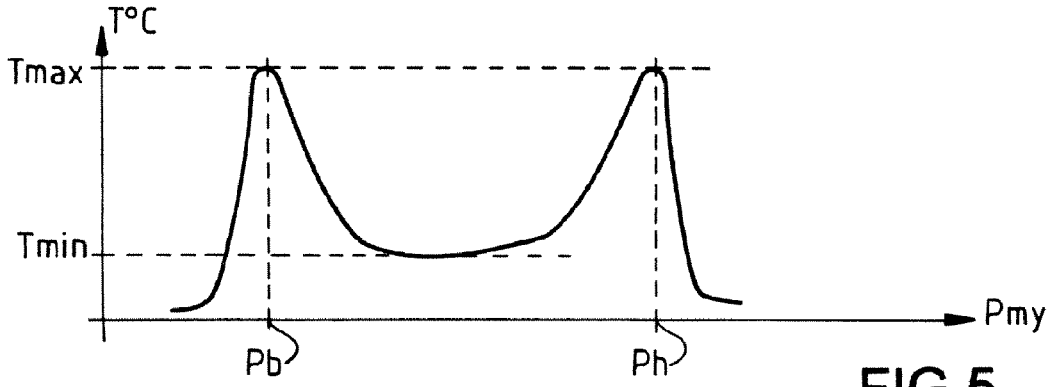
FIG. 5, which has already been described, shows the variation in the temperature of the collector depending on the mean position Mp of impact of the beam of the collector of FIG. 3.

The curve Cm0 of FIG. 8 shows, as in FIG. 5 of the prior art, the two temperature peaks of around 320° C. corresponding to the cusp of the sweep field in the collector.

FIG. 7*b* shows a sweep signal S (Ublm whose amplitude is normalized at 1) with a level of modulation m=1. The curve of FIG. 8 Cm1, corresponding to this level of modulation m=1, shows a considerable temperature peak of approximately 350° C. toward the middle of the sweep range of the beam in the collector. The variation in the temperature is considerable toward the center of the sweep range.

FIG. 7*c* shows a sweep signal S (Ublm whose amplitude is normalized at 1) with an optimum modulation level, namely m=0.625. The resulting curve Cm06 from this level of modulation of m=0.625 produces a temperature which is relatively constant in the beam sweep range and which, in any case, is lower than the temperature of the collector for other levels of modulation m. In the case of the curve Cm06, the temperature varies between 200° C. and 250° C.

In the case of a sweep modulation at three frequencies F1, F2 and F3, the lowest frequency (F3) will be chosen such that the period of this frequency is greater than the thermal constant of the collector, and thus the variation in temperature through the passing movement of the beam will be integrated into the collector.

In a simplified embodiment, the sweep modulation for spreading the beam comprises two angular frequencies, the angular frequency $\omega_1$ of the modulation signal and the angular frequency of a single modulating signal $\omega_2$.

The frequencies given by way of example as well as the optimum level of modulation are not restrictive. Indeed, these parameters can differ from one type of microwave tube to another as a result, for example, of the shape and dimensions of the collector, the objective being to choose these parameters so as to obtain a lowest and as constant as possible temperature variation along the conductive walls of the collector.

To this end, a computer simulation can be carried out to obtain the parameters for frequency and levels of modulation giving the best temperature variation results.

The invention claimed is:

1. A microwave power tube comprising:

an electron gun having a cathode that generates an electron beam in a microwave structure of the tube, a collector for collecting electrons from the beam, and a magnetic device for spreading the beam, which generates a magnetic spread field in the collector, wherein the magnetic spread field is periodic and amplitude modulated, wherein the magnetic device for spreading the beam comprise a solenoid fed with a beam-spreading electric signal, of angular frequency $\omega_1$, which is amplitude modulated by two other modulating signals, of angular frequencies $\omega_2$ and $\omega_3$ respectively, the spread signal being normalized at a unity amplitude S given by the equation: $S=(1+m \sin \omega_3 t \cdot \sin \omega_2 t)/(1+m)$; wherein m being the modulation parameter, with the value of m being between 0 and 1.

2. The microwave tube as claimed in claim 1, wherein the spreading device comprises a coil, with revolution axis ZZ', surrounding the conductive wall of the collector, the coil, which is fed with the spread signal, generating the magnetic spread field along the axis ZZ' of the collector.

3. The microwave tube as claimed in claim 2, wherein it comprises an electronic circuit providing the periodic signal which is amplitude-modulated to feed the coil creating the magnetic field for spreading the beam in the collector.

4. The microwave tube as claimed in claim 2, wherein the spread signal Ublm is given by the signal S which is normalized at an amplitude equal to 1, wherein Ublm=k.S, k being an amplification factor required to drive the collector solenoid.

5. The microwave tube as claimed in claim 1, wherein the beam-spreading device comprises, inside the collector, a coil for spreading the beam, with an axis that is collinear to the axis ZZ' of the collector, which is fed with the modulation signal creating the magnetic field for spreading the beam, along the axis ZZ', in the collector.

6. The microwave tube as claimed in claim 5, wherein it comprises an electronic circuit providing the periodic signal which is amplitude-modulated to feed the coil creating the magnetic field for spreading the beam in the collector.

7. The microwave tube as claimed in claim 5, wherein the spread signal Ublm is given by the signal S which is normalized at an amplitude equal to 1, wherein Ublm=k.S, k being an amplification factor required to drive the collector solenoid.

8. The microwave tube as claimed in claim 5, wherein the modulation frequencies of the feed signal for the coil are:

$$F1=1/\omega_1=50 \text{ Hz},$$

$$F2=1/\omega_2=5 \text{ Hz},$$

$$F3=1/\omega_3=0.5 \text{ Hz},$$

and in that the level of modulation is m=0.625.

9. The microwave tube as claimed in claim 1, wherein it comprises an electronic circuit providing the periodic signal which is amplitude-modulated to feed the coil creating the magnetic field for spreading the beam in the collector.

10. The microwave tube as claimed in claim 9, wherein the spread signal Ublm is given by the signal S which is normalized at an amplitude equal to 1, wherein Ublm=k.S, k being an amplification factor required to drive the collector solenoid.

11. The microwave tube as claimed in claim 1, wherein the spread signal Ublm is given by the signal S which is normalized at an amplitude equal to 1, where Ublm=k.S, k being an amplification factor required to drive the collector solenoid.

12. The microwave tube as claimed in claim 1, wherein the modulation frequencies of the feed signal for the coil are:

$$F1=1/\omega_1=50 \text{ Hz},$$

$$F2=1/\omega_2=5 \text{ Hz},$$

$$F3=1/\omega_3=0.5 \text{ Hz},$$

and in that the level of modulation is m=0.625.

13. The microwave tube as claimed in claim 12, wherein the lowest modulation frequency will be chosen such that the period thereof is greater than the thermal constant of the collector.

14. The microwave tube as claimed in claim 1, wherein a sweep modulation for spreading the beam comprises two angular frequencies, the angular frequency $\omega_1$ of the modulation signal and the angular frequency of a single modulating signal $\omega_2$.

15. The microwave tube as claimed in claim 1, wherein the spreading device comprises a coil, with revolution axis ZZ', surrounding the conductive wall of the collector, the coil, which is fed with the spread signal Ublm, generating the magnetic spread field (Bblm) along the axis ZZ' of the collector.

16. The microwave tube as claimed in claim 1, wherein the beam-spreading device comprises, inside the collector, a coil for spreading the beam, with an axis that is collinear to the axis ZZ' of the collector, which is fed with the modulation signal (Ublm) creating the magnetic field for spreading the beam, along the axis ZZ', in the collector.

17. The microwave tube as claimed in claim 1, wherein the spreading device comprises a coil, with revolution axis ZZ', surrounding the conductive wall of the collector, the coil, which is fed with the spread signal, generating the magnetic spread field along the axis ZZ' of the collector.

18. The microwave tube as claimed in claim 1, wherein the beam-spreading device comprises, inside the collector, a coil for spreading the beam, with an axis that is collinear to the axis ZZ' of the collector, which is fed with the modulation signal creating the magnetic field for spreading the beam, along the axis ZZ', in the collector.

19. The microwave tube as claimed in claim 1, wherein the sweep modulation for spreading the beam comprises two angular frequencies, the angular frequency $\omega_1$ of the modulation signal and the angular frequency of a single modulating signal $\omega_2$.

* * * * *